US007090048B2

(12) United States Patent
Albertson et al.

(10) Patent No.: US 7,090,048 B2
(45) Date of Patent: Aug. 15, 2006

(54) METHOD AND APPARATUS FOR EXHAUST SOUND ATTENUATION ON ENGINES WITH CYLINDER DEACTIVATION

(75) Inventors: William C. Albertson, Clinton Township, MI (US); Richard W. Hart, Oakland Township, MI (US); Aziz Bakar, Pontiac, MI (US)

(73) Assignee: General Motors Corporation, Detroit, MI (US)

( * ) Notice: Subject to any disclaimer, the term of this patent is extended or adjusted under 35 U.S.C. 154(b) by 353 days.

(21) Appl. No.: 10/672,199

(22) Filed: Sep. 26, 2003

(65) Prior Publication Data

US 2005/0067219 A1 Mar. 31, 2005

(51) Int. Cl.
*F01N 7/10* (2006.01)
*F01N 1/02* (2006.01)
*F02B 27/02* (2006.01)

(52) U.S. Cl. ..... 181/240; 181/237; 181/254; 181/250; 60/312; 60/323; 60/324

(58) Field of Classification Search ..... 181/240, 181/237, 254, 250; 60/312, 323, 324
See application file for complete search history.

(56) References Cited

U.S. PATENT DOCUMENTS

| | | | | | |
|---|---|---|---|---|---|
| 2,180,843 | A * | 11/1939 | Zand | 60/313 |
| 3,367,311 | A * | 2/1968 | Tenney | 123/65 E |
| 3,653,212 | A * | 4/1972 | Gast et al. | 60/293 |
| 3,943,710 | A * | 3/1976 | Lange | 60/288 |
| 4,097,071 | A | 6/1978 | Crawford et al. | 285/94 |
| 4,154,058 | A * | 5/1979 | Mase et al. | 60/293 |
| 4,342,195 | A * | 8/1982 | Lo | 60/313 |
| 4,527,392 | A * | 7/1985 | Sato et al. | 60/313 |
| 4,609,068 | A * | 9/1986 | Backlund | 181/226 |
| 4,787,869 | A * | 11/1988 | Shiozawa | 440/89 R |
| 4,926,635 | A * | 5/1990 | Sakuma | 60/299 |
| 5,144,799 | A * | 9/1992 | Barth | 60/313 |
| 5,216,883 | A * | 6/1993 | Flugger | 60/313 |
| 5,317,112 | A * | 5/1994 | Lee | 181/250 |
| 5,379,735 | A * | 1/1995 | Ma | 123/184.42 |
| 6,464,257 | B1 | 10/2002 | Cwik et al. | 285/49 |
| 6,662,900 | B1 * | 12/2003 | Cathcart et al. | 181/240 |
| 6,932,189 | B1 * | 8/2005 | Helber et al. | 181/240 |
| 6,938,729 | B1 * | 9/2005 | Worner et al. | 181/254 |

FOREIGN PATENT DOCUMENTS

| | | | |
|---|---|---|---|
| JP | 59068520 | A * | 4/1984 |
| JP | 63106324 | A * | 5/1988 |
| JP | 02099712 | A * | 4/1990 |
| JP | 04121407 | A * | 4/1992 |

* cited by examiner

*Primary Examiner*—Edgardo San Martin
(74) *Attorney, Agent, or Firm*—Christopher DeVries

(57) ABSTRACT

A system for attenuating exhaust noise from an engine with a first group of active cylinders and a second group of deactivatable cylinders includes a first exhaust manifold connected to the first group of active cylinders and a second exhaust manifold connected to the second group of deactivatable cylinders. The second exhaust manifold is connected to the first exhaust manifold such that the second exhaust manifold acts as a resonator to attenuate sound from the first group of active cylinders when the second group of cylinders is deactivated.

15 Claims, 3 Drawing Sheets

METHOD AND APPARATUS FOR EXHAUST SOUND ATTENUATION ON ENGINES WITH CYLINDER DEACTIVATION

TECHNICAL FIELD

The present invention relates to a method and apparatus for attenuating exhaust noise from an engine with cylinder deactivation wherein the exhaust manifold associated with the deactivated cylinders acts as a quarter-wave tuner to reduce exhaust noise.

BACKGROUND OF THE INVENTION

Cylinder deactivation is used for improving fuel efficiency in engines. Cylinder deactivation cuts off one-half of the available cylinders by deactivating valve lift in those cylinders such that the cylinders remain closed after a combustion cycle of the engine, and the burnt gases remain trapped within the cylinder during deactivation.

The remaining active cylinders on an engine which has some of its cylinders deactivated through valve deactivation generally work at a higher specific load. This higher specific load along with the reduction in exhaust pulse frequency raises concerns over higher amplitude and corresponding increased exhaust noise. Conventional means for attenuating exhaust sound, such as mufflers having resonators therein, usually come with a detrimental higher exhaust back pressure. This higher exhaust back pressure works to diminish the improvements gained from deactivating cylinders.

Accordingly, a need exists to address the exhaust noise problem associated with cylinder deactivation.

SUMMARY OF THE INVENTION

The inventor has recognized that on engines that have separate exhaust manifolds for active cylinders and deactivated cylinders (usually V-6, V-10, V-12, and some L4 and L6 engines), there is an opportunity to use the otherwise unused exhaust system volume in the deactivated side of the engine for sound attenuation. Sound attenuation is accomplished by joining the exhaust manifolds of the active and deactivated cylinders in such a way as to form a sound canceling or attenuating resonator (i.e., a Helmholtz attenuator or quarter-wave attenuator).

More specifically, the invention provides a system for attenuation of exhaust noise from an engine with a first group of active cylinders and a second group of deactivatable cylinders. The system includes a first exhaust manifold connected to the first group of active cylinders and a second exhaust manifold connected to the second group of deactivatable cylinders. The second exhaust manifold is connected to the first exhaust manifold such that the second exhaust manifold acts as a resonator to attenuate sound from the first group of active cylinders when the second group of cylinders is deactivated.

The second manifold may have a length which is approximately one-quarter the wavelength of sound attenuating from the first group of cylinders, thereby forming a quarter-wave tuner or attenuator. Alternatively, a valve may be positioned in the second manifold for selectively adjusting the effective attenuation length of the second manifold. The sound waves would reflect off the valve when the valve is closed.

As a further alternative, first and second manifolds may be interconnected by a pipe, and a downstream valve may be positioned in the second manifold between a tailpipe and the point at which the second manifold connects to the pipe. A crossover valve may be positioned in the pipe to selectively connect the first and second manifolds. Other valves may be connected as desired to adjust the effective length of the second manifold.

The engine may be transversely or longitudinally oriented. The "manifold" could include multiple pipes connected by joints or formed in any configuration.

The invention also provides a method of attenuating exhaust noise from an engine as described above, wherein the method includes connecting the second exhaust manifold to the first exhaust manifold such that the second exhaust manifold acts as a resonator to attenuate sound from the first group of active cylinders when the second group of cylinders is deactivated.

The above features and advantages, and other features and advantages of the present invention are readily apparent from the following detailed description of the best modes for carrying out the invention when taking in connection with the accompanying drawings.

DESCRIPTION OF THE PREFERRED EMBODIMENTS

Figure 1:
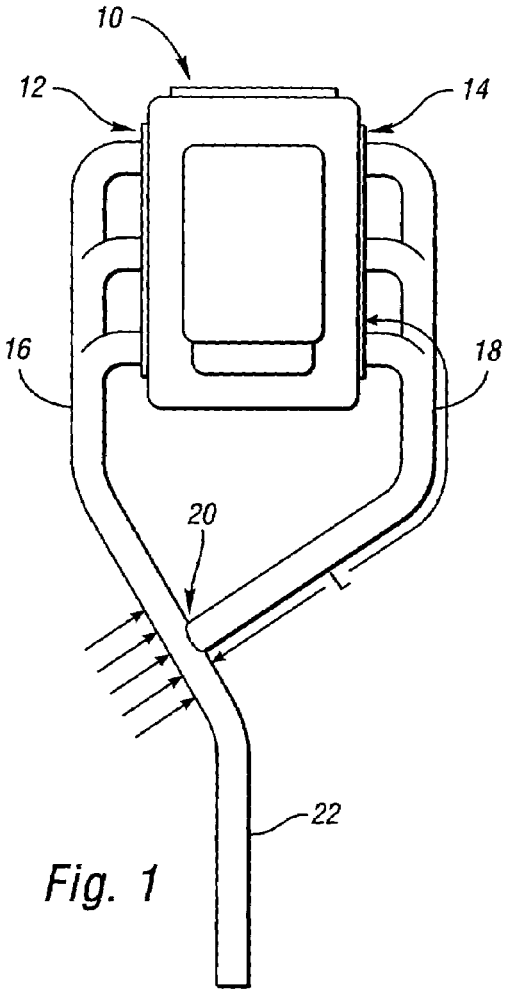
FIG. 1 is a schematic illustration of an engine having a system for attenuating exhaust noise in accordance with a first embodiment of the invention.

FIG. 1 shows a schematic top view of an engine 10 incorporating a system for attenuating exhaust noise in accordance with a first embodiment of the invention. The engine 10 is a V-type engine having a first group of active cylinders 12 and a second group of deactivatable cylinders 14. A first exhaust manifold 16 is connected to the first group of active cylinders 12, and a second exhaust manifold 18 is connected to the second group of deactivatable cylinders 14. The second exhaust manifold 18 is connected to the first exhaust manifold 16 at a connection point 20 such that the second exhaust manifold 18 acts as a resonator to attenuate sound from the first group of active cylinders 12 when the second group of cylinders 14 is deactivated.

The length and volume of the second exhaust manifold 18 is selected for maximum sound attenuation.

Preferably, the length L of the second exhaust manifold 18 is selected to form a quarter wave tuner such that the length L of the second manifold is approximately one-fourth the wavelength of sound attenuating from the first group of active cylinders 12. By properly positioning the connection point 20 and selecting the appropriate length L for the second exhaust manifold 18, the objectionable exhaust pressure pulses from the active cylinders may be attenuated.

As shown in FIG. 1, the first and second exhaust manifolds 16, 18 are connected to the exhaust pipe 22, which leads to the tailpipe.

Figure 2:
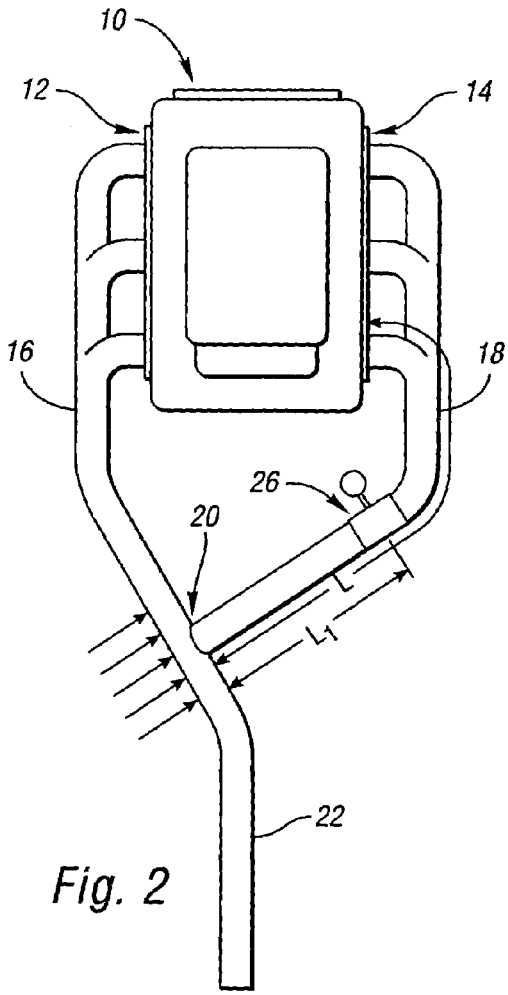
FIG. 2 is a schematic illustration of an engine having a system for attenuating exhaust noise in accordance with a second embodiment of the invention.
Figure 2A:
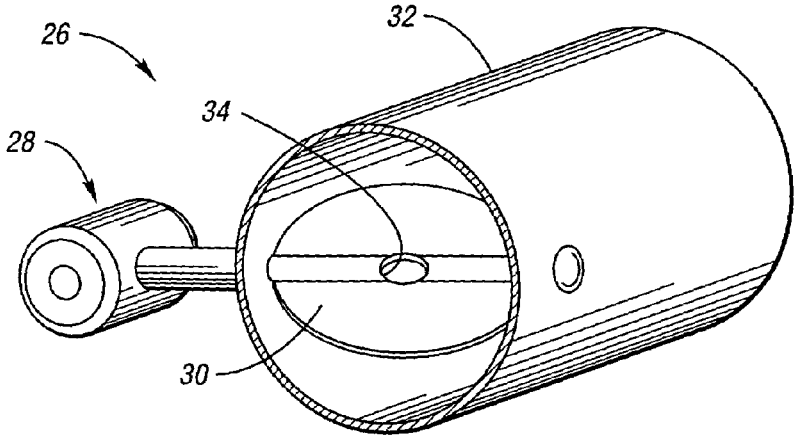
FIG. 2*a* shows a enlarged schematic perspective of the valve of FIG. 2.

Turning to FIG. 2, an engine 10 is shown schematically including a system for attenuating exhaust noise in accordance with a second embodiment of the invention. In FIG. 2, like reference numerals are used to refer to like components from FIG. 1. As shown, the engine 10 includes a first group of active cylinders 12 and a second group of deactivatable cylinders 14. The first group of active cylinders 12 is connected to a first exhaust manifold 16, and the second group of deactivatable cylinders 14 is connected to a second exhaust manifold 18. The first and second exhaust manifolds 16, 18 are joined at the connection point 20. In this embodiment, a valve 26 is positioned along the length of the second exhaust manifold 18. The valve 26 is preferably a butterfly valve as shown in FIG. 2*a*, and includes an actuator 28 operatively connected to a rotatable valve plate 30, which is supported within a tube 32 on a rotatable shaft 33. The valve plate 30 has a hole 34 formed in the middle to produce a Helmholtz-type resonator. The distance $L_1$ between the connection point 20 and the valve 26 is preferably selected to provide a quarter (¼) wave resonator so that the exhaust pressure pulses or sound waves emanating from the first group of active cylinders 12 are cancelled by waves reflected from the resonator.

This embodiment allows the selection of two different resonator geometries, one with length $L_1$, and another with length L, depending upon whether the valve 26 is open or closed. This would allow the attenuation system to cover a wider range of exhaust frequencies. The valve 26 would be opened under high engine load when the deactivated cylinders are reactivated.

Figure 3:
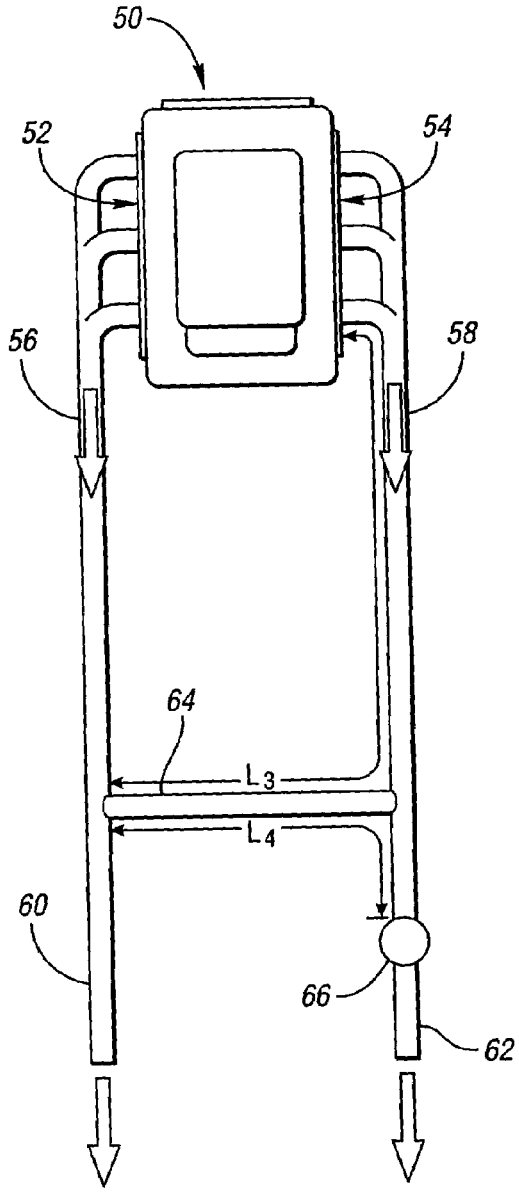
FIG. 3 is a schematic illustration of a longitudinal engine having a system for attenuating exhaust noise in accordance with a third embodiment of the invention, wherein the system has a single valve.

FIG. 3 shows a schematic illustration of a longitudinally oriented engine having a first group of active cylinders 52 and a second group of deactivatable cylinders 54. The first group of active cylinders 52 is connected to a first exhaust manifold 56, and the second group of deactivatable cylinders 54 is connected to a second exhaust manifold 58. The first exhaust manifold 56 leads to a first tailpipe 60 and the second exhaust manifold 58 leads to a second tailpipe 62. A pipe 64 connects the first and second manifolds 56, 58. Also, a downstream valve 66 is connected in the second manifold 58 between the tailpipe 62 and the point at which the second manifold 58 connects to the pipe 64. In this configuration, two resonator lengths are provided, $L_3$, $L_4$. The length $L_3$ includes the length of the pipe 64 and the portion of the exhaust manifold 58 between the pipe 64 and the second group of cylinders 54. The length $L_4$ includes the length of the pipe 64 and the distance between the valve 66 and the point at which the pipe 64 connects to the second exhaust manifold 58. Accordingly, two different cancellation waves are provided having wavelengths $L_3$ and $L_4$. Therefore, different pressure pulse wavelengths can be cancelled when the second group of cylinders 54 is deactivated.

Figure 4:
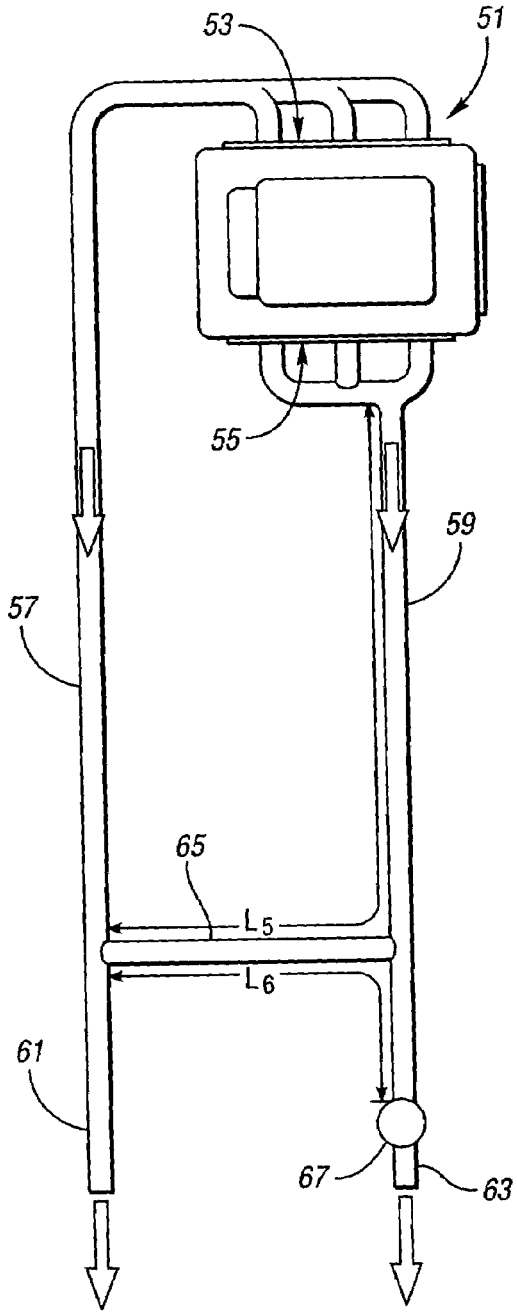
FIG. 4 is a schematic illustration of a transverse engine having a system for attenuating exhaust noise in accordance with a fourth embodiment of the invention, wherein the system has a single valve.

Turning to FIG. 4, a fourth embodiment of the invention is shown wherein a transversely mounted engine 51 includes a first group of active cylinders 53 and a second group of deactivatable cylinders 55 connected to first and second exhaust manifolds 57, 59, respectively. The first exhaust manifold 57 leads to the first tailpipe 61, and the second exhaust manifold 59 leads to the second tailpipe 63. The first exhaust manifold 57 is connected to the second exhaust manifold 59 by the pipe 65. Like the embodiment of FIG. 3, a valve 67 is provided in the exhaust manifold 59 between the tailpipe 63 and the point at which the pipe 65 connects to the exhaust manifold 59. In this configuration, the lengths $L_5$ and $L_6$ are available for acting as resonators to attenuate sound from the first group of active cylinders 53 when the second group of cylinders 55 is deactivated. Accordingly, sound waves or pressure pulses having different wavelengths from the active cylinders 53 may be cancelled. Specifically, the sound waves would travel from the active cylinders 53 down the exhaust manifold 57 and through the pipe 65 to the exhaust manifold 59. The waves would then turn toward the engine 51 or toward the valve 67 and be reflected back. The reflected waves are out of phase with the original waves by the amounts $L_5$ or $L_6$, which approximate one-quarter of the wavelength of the wave for canceling the wave. The location of the valve 67 may be selected based upon the noise frequency to be attenuated.

Figure 5:
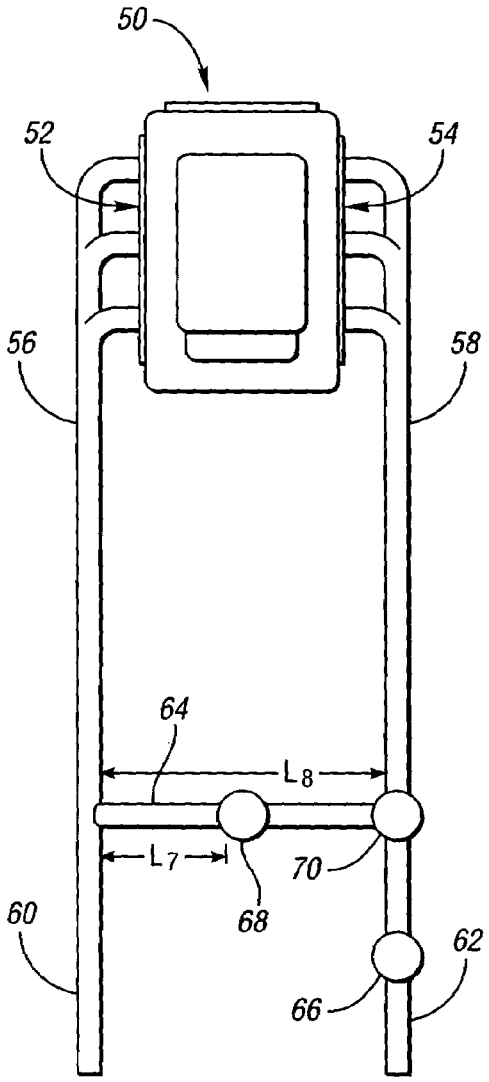
FIG. 5 is a schematic illustration of a longitudinal engine having a system for attenuating exhaust noise in accordance with a fifth embodiment of the invention, wherein the system has three valves.

FIG. 5 shows a longitudinally oriented engine 50 having a system for attenuating exhaust noise in accordance with a fifth embodiment of the invention. In FIG. 5, like reference numerals are used to describe like components from FIG. 3. The embodiment of FIG. 5 is in all respects identical to the embodiment of FIG. 3, except that the additional flow valves 68, 70 are provided to provide the additional optional resonator lengths $L_7$ and $L_8$, in addition to the lengths $L_3$ and $L_4$ shown in FIG. 3. Any of the various lengths may be selected simply by appropriately adjusting the valves 66, 68, 70. For example, if the length $L_8$ is desired, then valve 68 is opened and valve 70 is closed, and the waves are reflected off the valve 70. If the length $L_7$ is desired, then valve 68 is closed and the waves are reflected off the valve 68.

Figure 6:
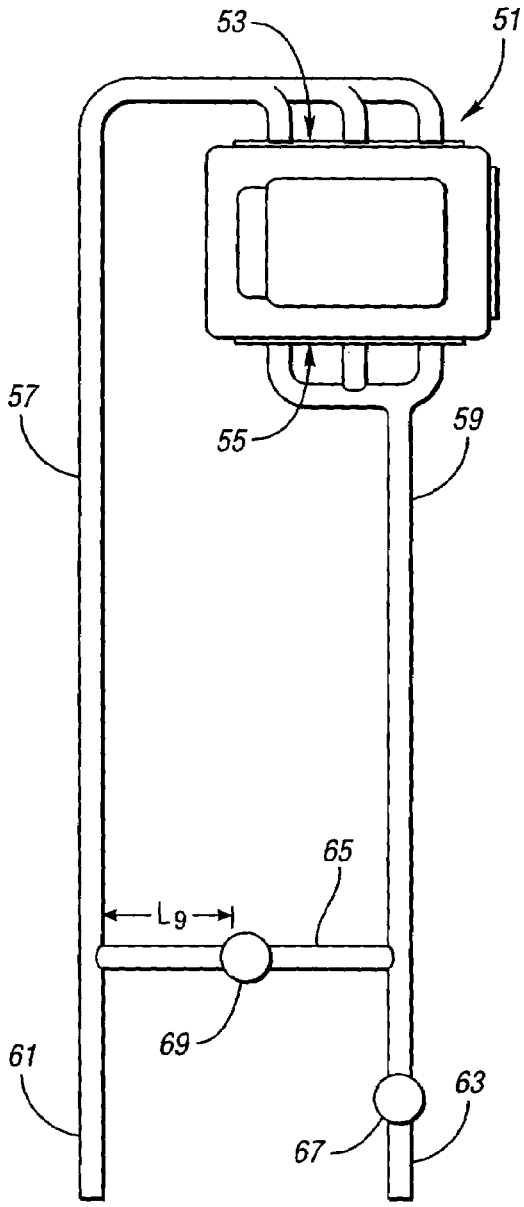
FIG. 6 is a schematic illustration of a transverse engine having a system for attenuating exhaust noise in accordance with a sixth embodiment of the invention, wherein the system has two valves.

Turning to FIG. 6, an engine 51 is shown having a system for attenuating exhaust noise in accordance with a sixth embodiment of the invention. In FIG. 6, like reference numerals are used to refer to like components from FIG. 4. The embodiment of FIG. 6 is in all other respects identical to the embodiment of FIG. 4, except that the additional crossover valve 69 is added to add the additional optional resonator length $L_9$ when the valve 69 is closed, in addition to the resonator lengths $L_5$ and $L_6$ illustrated in FIG. 4, which are available when the valve 69 is opened. Accordingly, in this configuration, quarter wave tuner lengths $L_5$, $L_6$ and $L_9$ are available to selectively cancel waves of different wavelength emanating from the first group of active cylinders 53 when the cylinders 55 are deactivated.

By way of example, wavelengths of sound emanating from an active group of cylinders may vary between 7 and 25 meters, in which case the selected quarter wavelength would vary between approximately 1.8 and 6.2 meters, such as in a V-6 engine. In a V-12 engine, the wavelength of sound emanating from the active cylinders may be between approximately 3.7 and 12.5 meters, and the quarter wavelength would be selected between approximately 0.9 and 3.1 meters so that the manifold lengths, or valve positions, would be selected accordingly to provide the optimal quarter wave tuner effect.

The invention also provides a method of attenuating exhaust noise from an engine as described above. The method may include providing the various connections described above between the exhaust manifolds, and providing and operating the various valves shown in the different embodiments of the invention.

This invention may apply to any engine in which exhaust manifolds for a deactivated bank and an active bank of cylinders can be separated.

While the best modes for carrying out the invention have been described in detail, those familiar with the art to which this invention relates will recognize various alternative designs and embodiments for practicing the invention within the scope of the appended claims.

The invention claimed is:

1. A method of attenuating exhaust noise from an engine with a first group of active cylinders connected to a first exhaust manifold and a second group of deactivatable cylinders connected to a second exhaust manifold, the method comprising:

connecting the second exhaust manifold to the first exhaust manifold such that the otherwise unused volume of the second exhaust manifold acts as a resonator to attenuate sound from the first group of active cylinders when the second group of cylinders is deactivated.

2. The method of claim 1, further comprising selecting the length of the second manifold to form a one-quarter wave tuner such that the length of the second manifold is approximately one-quarter (¼) the wavelength of sound emanating from the first group of active cylinders.

3. The method of claim 1, further comprising selectively adjusting the effective length of the second manifold by closing a valve positioned in the second manifold.

4. The method of claim 1, further comprising connecting the first and second exhaust manifolds with a pipe, and providing a downstream valve in the second manifold between a tailpipe and the point at which the second manifold connects to said pipe.

5. The method of claim 4, further comprising providing a crossover valve in the pipe to selectively connect the first and second manifolds.

6. A system for attenuating exhaust noise from an engine with a first group of active cylinders and a second group of deactivatable cylinders, the system comprising:

a first exhaust manifold connected to the first group of active cylinders; and a second exhaust manifold connected to the second group of deactivatable cylinders;

said second exhaust manifold being connected to the first exhaust manifold such that the otherwise unused volume of the second exhaust manifold acts as a resonator to attenuate sound from the first group of active cylinders when the second group of cylinders is deactivated.

7. The system of claim 6, wherein the second manifold has a length which is approximately one-quarter (¼) the wavelength of sound emanating from the first group of cylinders, thereby forming a one-quarter wave timer.

8. The system of claim 6, further comprising a valve positioned in the second manifold for selectively adjusting the effective attenuation length of the second manifold.

9. The system of claim 6, further comprising a pipe connecting the first and second manifolds, and a downstream valve positioned in the second manifold between a tailpipe and the point at which the second manifold connects to the pipe.

10. The system of claim 9, further comprising a crossover valve in the pipe to selectively connect the first and second manifolds.

11. The system of claim 6, wherein the engine is a transversely oriented engine.

12. The system of claim 6, wherein the engine is a longitudinally oriented engine.

13. The system of claim 6, further comprising first and second tailpipes connected to the first and second manifolds, respectively.

14. A system for attenuating exhaust noise from an engine with a first group of active cylinders and a second group of deactivatable cylinders, the system comprising:

a first exhaust manifold connected to the first group of active cylinders;

a second exhaust manifold connected to the second group of deactivatable cylinders;

said second exhaust manifold being connected to the first exhaust manifold such that the otherwise unused volume of the second exhaust manifold acts a resonator to attenuate sound from the first group of active cylinders when the second group of cylinders is deactivated; and a valve positioned in the second manifold for selectively adjusting the effective length of the second manifold to provide an effective length which is approximately one-fourth the wavelength of sound emanating from the first group of cylinders, thereby forming a quarter-wave tuner.

15. The system of claim 14, wherein said valve has a hole formed therein to form a Helmholtz resonator.

* * * * *